US007918346B2

(12) United States Patent
Roppo et al.

(10) Patent No.: US 7,918,346 B2
(45) Date of Patent: Apr. 5, 2011

(54) VIBRATING SCREEN TENSIONING APPARATUS AND METHOD

(76) Inventors: Mark Roppo, Graham, WA (US); Randall O. Parker, Graham, WA (US)

( * ) Notice: Subject to any disclaimer, the term of this patent is extended or adjusted under 35 U.S.C. 154(b) by 124 days.

(21) Appl. No.: 12/455,266

(22) Filed: May 30, 2009

(65) Prior Publication Data

US 2009/0294335 A1 Dec. 3, 2009

Related U.S. Application Data

(60) Provisional application No. 61/130,413, filed on May 31, 2008.

(51) Int. Cl.
*B07B 1/49* (2006.01)

(52) U.S. Cl. ..... 209/405; 209/411; 209/412

(58) Field of Classification Search ..... 209/411, 209/412, 309, 327, 333, 409, 405, 408, 334, 209/404, 372, 313
See application file for complete search history.

(56) References Cited

U.S. PATENT DOCUMENTS

| | | | | | |
|---|---|---|---|---|---|
| 1,711,548 | A | * | 5/1929 | Soldan | 209/405 |
| 2,136,950 | A | | 11/1938 | Overstrom | |
| 2,190,993 | A | * | 2/1940 | Muir | 209/319 |
| 2,630,225 | A | | 3/1953 | Bye | |
| 2,804,208 | A | * | 8/1957 | Van Hardefeld et al. | 209/403 |
| 3,081,874 | A | | 3/1963 | Corbin et al. | |
| 3,101,314 | A | | 8/1963 | Johnson | |
| 3,307,699 | A | | 3/1967 | Shira | |
| 3,346,114 | A | * | 10/1967 | Hoyt | 209/403 |
| 3,557,953 | A | * | 1/1971 | Hubach et al. | 209/404 |
| 3,718,963 | A | | 3/1973 | Hawkins et al. | |
| 4,137,157 | A | * | 1/1979 | Deister et al. | 209/403 |
| 4,582,597 | A | | 4/1986 | Huber | |
| 5,028,316 | A | | 7/1991 | Gerren | |
| 5,037,536 | A | * | 8/1991 | Koch et al. | 209/325 |
| 5,104,521 | A | | 4/1992 | Rutherford | |
| 5,248,044 | A | * | 9/1993 | Szilvasi | 209/411 |
| 5,310,482 | A | * | 5/1994 | Sather | 210/485 |
| 5,332,101 | A | | 7/1994 | Bakula | |
| 5,513,756 | A | | 5/1996 | McKillion et al. | |
| 5,785,461 | A | | 7/1998 | Lambert | |
| 5,816,412 | A | | 10/1998 | Bokor | |
| 6,029,822 | A | | 2/2000 | Skoropa | |
| 6,053,329 | A | | 4/2000 | Ballman | |
| 6,073,979 | A | * | 6/2000 | Nawalaniec et al. | 292/256 |
| 6,283,303 | B1 | | 9/2001 | Lane et al. | |
| 6,290,069 | B1 | * | 9/2001 | Schwarze et al. | 209/405 |
| 6,659,286 | B2 | * | 12/2003 | Seyffert et al. | 209/405 |
| 6,669,027 | B1 | | 12/2003 | Mooney et al. | |
| 6,892,889 | B2 | | 5/2005 | Hukki et al. | |
| 6,935,511 | B2 | | 8/2005 | Seyffert et al. | |
| 2003/0057140 | A1 | * | 3/2003 | Hukki et al. | 209/405 |
| 2003/0066786 | A1 | * | 4/2003 | Seyffert et al. | 209/405 |
| 2005/0092659 | A1 | | 5/2005 | MacNaughton | |

* cited by examiner

*Primary Examiner* — Stefanos Karmis
*Assistant Examiner* — Brett C Martin
(74) *Attorney, Agent, or Firm* — William Forster

(57) ABSTRACT

A tensioning apparatus for tensioning a screen in a vibrating screen separator of the type having a box structure defined by two opposing spaced-apart upright side walls separated by at least one screen bed support structure. Included is an actuator support mounted to an exterior surface of a side wall of a box structure for pivotally securing the stationary end of an actuator thereto. The actuator includes a movable end that is cyclically movable from a first releasing position adjacent the sidewall, to a second engaging position, transversely spaced apart from the side wall, responsive to a track follower moving along a track inclined transversely to the side wall of the box. A clamp rail assembly is fixed to the movable end of the actuator to engage and tension a screen responsive to transverse movement of the movable end of the actuator.

20 Claims, 6 Drawing Sheets

VIBRATING SCREEN TENSIONING APPARATUS AND METHOD

This application claims the benefit of U.S. Provisional Application No. 61/130,413 filed May 31, 2008.

BACKGROUND

This invention relates generally to vibrating screen machinery for classifying, screening and separating crushed rock and the like, and more particularly to means for tensioning screens employed in such vibrating type equipment.

Vibrating screen machinery for classifying crushed rock is well known in the art. For that purpose, various types of prior art tensioning devices for tensioning screens in screening apparatus have been employed. Typically, side rails are used for tensioning screens across a screen deck. Side rails are relatively heavy, rigid members mounted on the sides of the box or other support in a manner to engage the screen and stretch it when a bolt or the like is tightened. When the bolt is released, in the conventional construction, the stretcher bar is not supported in place so it falls of its own weight onto the screen, binding the screen against the support. The side rails or clamp rails are removably attached to upright side walls or panels in the deck in a manner such that the rails engage a screen at its side edges and tension is applied to the screen in a secure manner.

Multiple vibrating screens are normally used, with a top screen separating the largest size of material, such as sand, gravel, crushed stone and the like, with the material which passes through the top screen falling onto an intermediate screen. The intermediate screen separates an intermediate size of material, with the remainder falling through the intermediate screen onto a finer screen, which in turn separates the larger particles of those falling onto it and the smallest size falling through for collection beneath.

Various techniques have been used to removably attach the side rails to the box side walls or panels. For example, U.S. Pat. No. 2,630,225 issued to Bye in 1953, and U.S. Pat. No. 3,718,963 issued to Hawkins in 1973 both illustrate side rails being bolted to the side walls in order to apply tension to the screen. Indeed, this very common technique involves the use of bolts or pins which extend through apertures in the side rails and corresponding apertures in the side walls. A fastener is then used to secure the bolt or pin in place. The bolt or pin head is thus located on the side of screen rail which is exposed to the rock being screened or sorted.

The entire screen deck assembly is vibrated, usually to produce a slow forward movement and a rapid rearward movement, so that the rock material will move forward with the screen but, due to inertia will permit the screen to move rearwardly under it. As a result, the rock material will work its way forwardly on the respective screen, so that material which does not fall through the screen will be discharged from the front end of the respective screen, for collection.

In order to remove a screen, it has typically been necessary to remove the nut from each bolt outside the wall or panel and then reach inside the assembly to pull the bolts out of the side rail. After the old screen has been replaced by a new screen, it is necessary to insert each bolt, from the inside, through a hold in the side rail and then through the hole in the side wall or panel after which the nut may be replaced and tightened. Accordingly, since the side walls or panels prevent access to, and any view of the side rail, from the outside of the panel, help from someone on the outside of the panel is difficult at best, except to place the washer and nut on the threaded end of the bolt, after it has been pushed through the hole in the side panel. The removal of the bolts, as well as replacing them, adds to the time consumed and the expense of changing a side rail of screen. Accordingly, it requires a minimum of two workers to insert the screen, as one must hold up the stretcher bar at each side of the screen. Moreover, there are many times when the side rails or stretcher bars must be completely removed from the machine because the design of the machine, as in multiple-deck machines, is such that the bars cannot be reached, to be manually held clear of the support. This may require removal of an upper screen, which may not need replacing. This assembly and disassembly work is considerable, and the result in any case is that a machine is out of operation for a substantial length of time whenever a screen must be removed and replaced.

A similar procedure, is used when employing pins instead of threaded bolts or wedges in combination with bolts. The pins include an elongated slotted aperture into which a wedge-shaped retainer is driven to tension the pin after it has been inserted through registering holes or openings in the screen rail and the side wall or panel. One example of this use of wedges is U.S. Pat. No. 3,307,699 issued to Shira in 1967.

Importantly, a further problem of past designs is the lack of a suitable method to apply the proper tension load to the bolt for effective fastening and tensioning of screens subject to considerable shaking and vibratory motion. The problem with this type of arrangement is that there is no precise way, in the absence of using a torque wrench, for determining how much tensioning force is applied to the draw bolts. Frequently, this method results in side clamp rails or stretcher bars which are unequally tensioned at various points along their lengths thereby causing uneven tension to the screens. Further, on a machine having three screens, there is usually at least twenty four draw bolts to secure the clamp rail. Each draw bolt is tightened by a nut which must be turned numerous times during both the tightening and loosening procedure. Unfortunately, this procedure is extremely time consuming. Indeed, as the screens wear or become damaged, the tension thereon is reduced below a proper level. Accordingly, it is necessary that fastening and tensioning means be frequently checked to maintain proper tension yet allow for replacement of parts and screens that wear or become damaged.

Often only limited access is available to adjust the tensioning devices which also makes it difficult to maintain proper tension adjustment. Similarly, prior tensioning devices have not been particularly effective in preventing screen loosening caused by the vibratory action of the equipment. This further results in the necessity of frequent attention to maintain proper screen tension.

Finally, it should also be noted that the flow of material to be screened must be stopped during the procedure of changing or replacing the screen. Hence, the longer the time required for changing the screens, the greater the loss of material which could have been screened during the machine down time.

Accordingly, a need remains for a vibrating screen tensioning apparatus that enables an operator to quickly change and replace worn screens. Beyond this, a need remains for a screen tensioning apparatus that can maintain precise screen tension during the operation of the vibrating screen equipment.

SUMMARY

One object of the invention is to adapt existing. screen equipment to enable an operator to quickly and efficiently replace and change screens in the vibrating screen equipment.

A second object is to maintain consistent, precise screen tension in vibrating screen machinery during the operation thereof.

Another object is to reduce the cost of changing screens in screen equipment.

Yet another object is to enable a operator to easily manipulate and remove the screens in vibrating screen equipment.

A further object is to reduce the time required to replace damaged, worn screens in vibrating screen equipment.

Still another object is to improve the efficiency thereby lowering the costs associated with the operation of screening equipment.

An additional object is to improve the safety of procedures associated with releasing tension in screens to change the same in screening equipment.

The invention is a tensioning apparatus for tensioning a screen in a vibrating screen separator of the type having a box structure defined by two opposing spaced-apart upright side walls. Typically, the side walls are separated by at least one screen bed support structure. It should be noted that the present invention can be added to existing vibrating screen equipment, or it can be included as a feature in new screening equipment.

The tensioning apparatus comprises an actuator support mounted to an exterior surface of a side wall of a box structure. In this way, a stationary end of an elongate actuator can be pivotally linked to the actuator support. In addition, a suitable actuator includes a movable end that is cyclically movable from a first releasing position adjacent the sidewall, to a second engaging position.

A clamp rail assembly is linked to the movable end of the actuator, wherein the clamp rail assembly projects from the movable end of the actuator, through an opening formed in the side wall, into the box structure adjacent a screen hook disposed on the edge of a screen.

Adjacent the exterior surface of the sidewall, an elongate track is provided and is oriented relative to the actuator to enable the movable end of the actuator to move in a direction along the track. Importantly, portions of the track are transversely inclined relative to the upright side wall so that the distance from the track to the sidewall varies along the track.

A track follower is positioned for sliding engagement with the track, the track follower is linked to the clamp rail assembly so that movement of the track follower, responsive to the track variations, are communicated to the clamp rail assembly as the track follower slides along the track.

A lower portion of the track is inclined from the side wall to vary the track to increase the distance between the track and the side wall as the movable end of the actuator moves to the second engaging position. Accordingly, responsive to track variations, the track follower is urged in a transverse direction, away from the side wall causing transverse movement of the clamp rail assembly to engage the screen hook disposed on the edge of the screen and urge the same toward the side wall to tension the screen across the screen bed support structure.

In another aspect of the invention, a portion of the track is inclined toward the side wall to vary the track to decrease the distance between the track and the side wall as the movable end of the actuator moves from the first releasing position toward the second engaging position. As a result, responsive to the track variations, the track follower is urged in a transverse direction, toward the sidewall causing the clamp rail assembly to move in a transverse direction toward the screen prior to engagement with the screen.

The foregoing and other objects, features, and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF PREFERRED EMBODIMENT

Figure 1:
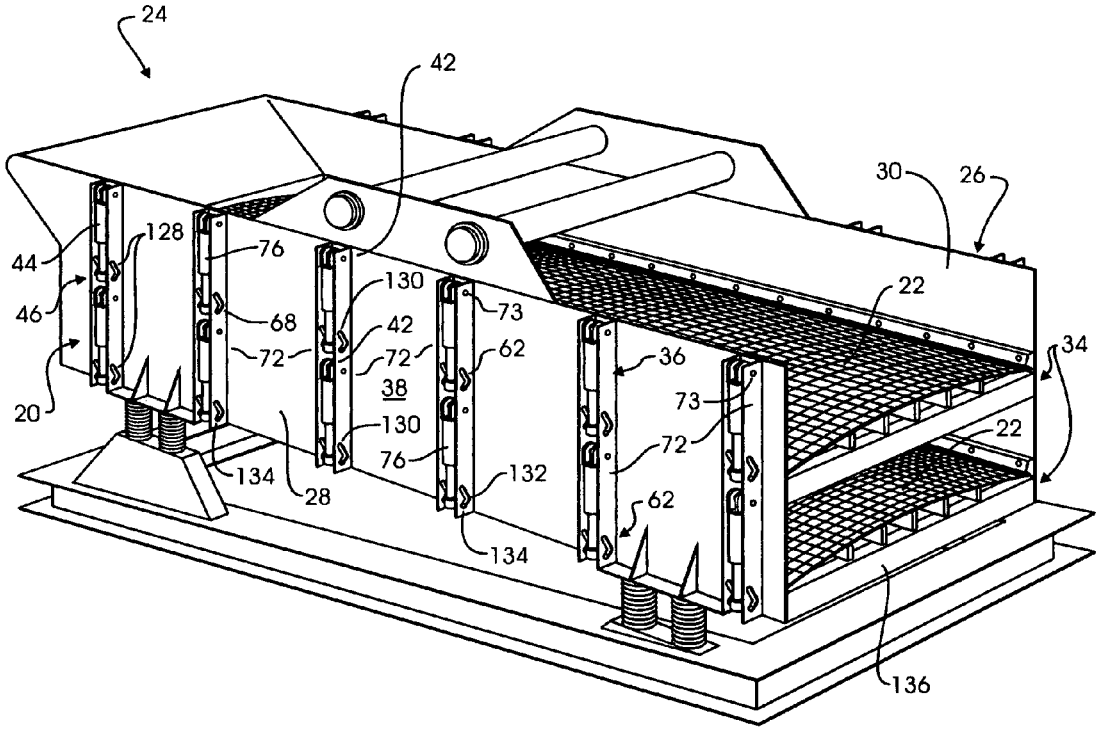
FIG. 1 is a front perspective view of vibrating screen equipment that incorporates an embodiment of the present invention, wherein the screen equipment includes multi-deck screen layers disposed between a screen box.

The invention is a tensioning apparatus 20 for tensioning a screen 22 in a vibrating screen separator 24 of the type having a box structure 26 defined by two opposing spaced-apart upright side walls 28 and 30. Typically, the side walls 28, 30 are separated by at least one screen bed support structure 34. Typically, vibrating screen separators include at least three substantially identical, vertically stacked, screen bed support structures 34. It should be noted that the present invention can be retrofitted to existing vibrating screen equipment, or it can be included as a feature in new screening equipment.

The tensioning apparatus 20 comprises at least one, actuator support 36 mounted to an exterior surface 38 of the side wall 28 of a box structure. In this way a stationary end 42 of an elongate actuator 44 can be pivotally linked to the actuator support 36. As will be discussed more fully below, an embodiment of the present invention includes a plurality of alike tensioning apparatus adjacent each side wall to properly tension multiple screens disposed on multiple vertically stacked decks within the box structure 26.

In addition, a suitable actuator 44 includes a movable end 46 that is cyclically movable from a first releasing position (FIG. 2—top deck 48) adjacent the sidewall 28, to a second engaging position as illustrated in bottom deck 50.

Figure 5:
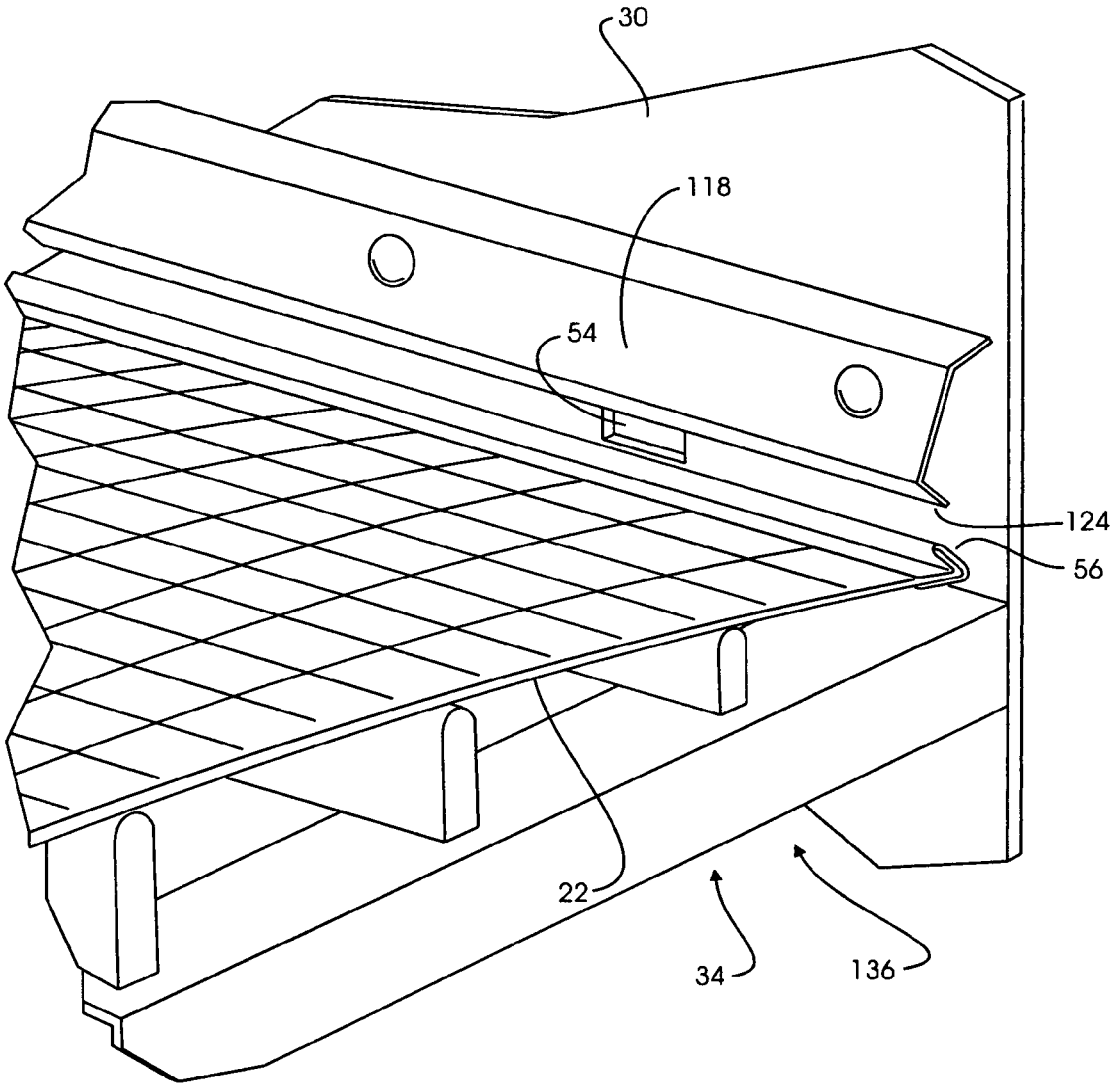
FIG. 5 is an exploded perspective view of a clamp rail disengaged from a screen hook.

A clamp rail assembly 52 is linked to the movable end 46 of the actuator 44, wherein the clamp rail assembly 52 projects from the movable end 46 of the actuator 44, through an opening 54, like that illustrated in FIG. 5, formed in the side wall 28, into the box structure 26 adjacent a screen hook 56 disposed on the edge of a screen 22.

Adjacent the exterior surface 38 of the sidewall 28, an elongate track 62 is provided and is oriented relative to the actuator 44 to enable the movable end 46 of the actuator to move in a direction along the track 62. Importantly, portions of the track 62 are inclined relative to the side wall 28 so that the distance from the track 62 to the sidewall 28 varies along the track 62.

A track follower 66 is positioned for sliding engagement with the track 62, the track follower is linked to the clamp rail assembly 52 so that movement of the track follower 66, responsive to the track variations, are communicated to the clamp rail assembly 52 as the track follower 66 slides along the track 62.

A lower portion 68, of the track 62, is inclined from the side wall 28 to vary the track 62 to increase the distance between the track 62 and the side wall as the movable end 46 of the actuator 44 moves to the second engaging position illustrated in bottom deck 50. Accordingly, responsive to track variations, the track follower 66 is urged in a transverse direction, away from the side wall 28 causing transverse movement of the clamp rail assembly 52 to engage the screen hook 56 disposed on the edge of the screen 22 and urge the same toward the side wall 28 to tension the screen 22 across the screen bed support structure 34.

Figure 2:
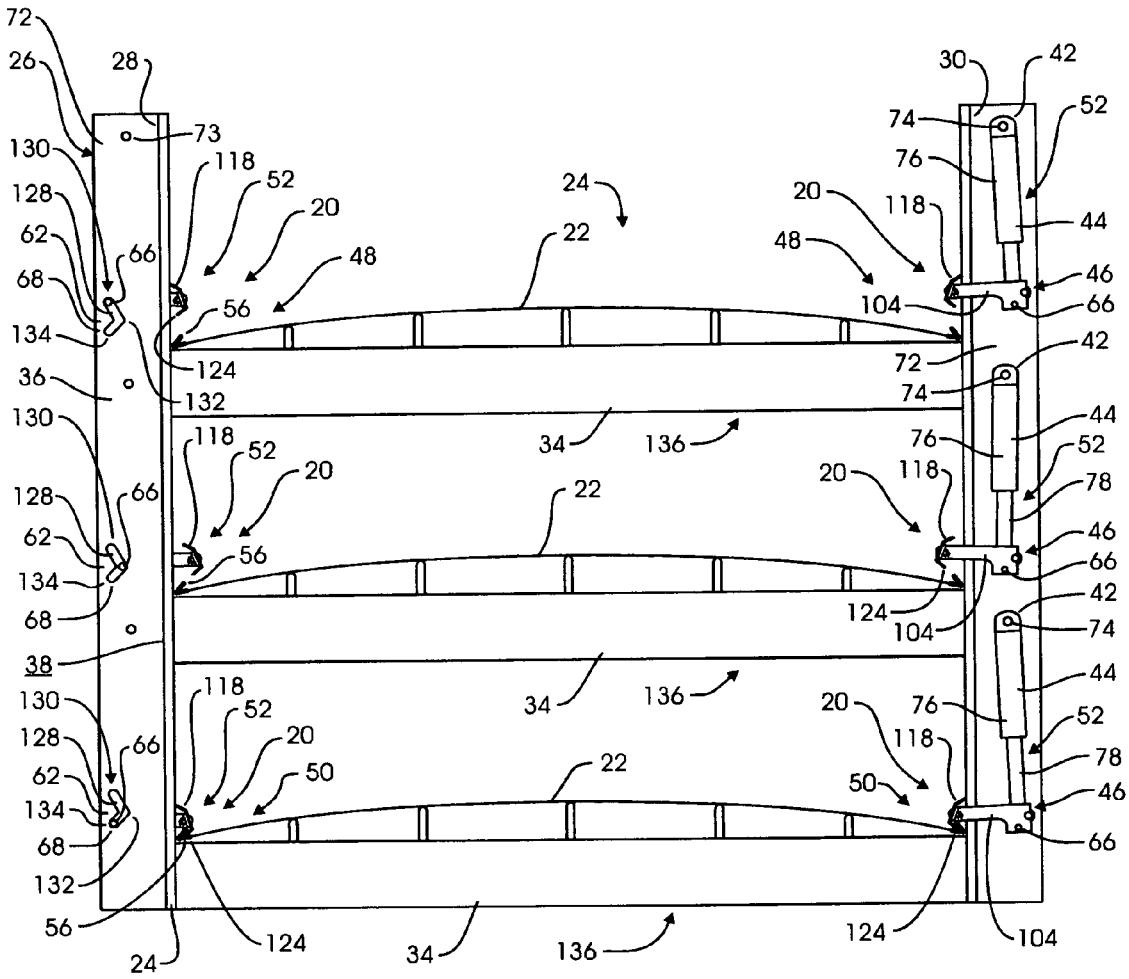
FIG. 2 is a cross section of a screen box structure that incorporates an embodiment of the present invention showing the sequence of the screen tightening process where the top deck illustrates the clamp rail disengaged from the screen hook, the middle deck illustrates the clamp rail moving downward prior to engagement with the screen hook, and the bottom deck illustrating the rail fully engaged with the screen hook to apply tension to the screen across the bottom deck support structure.
Figure 2A:
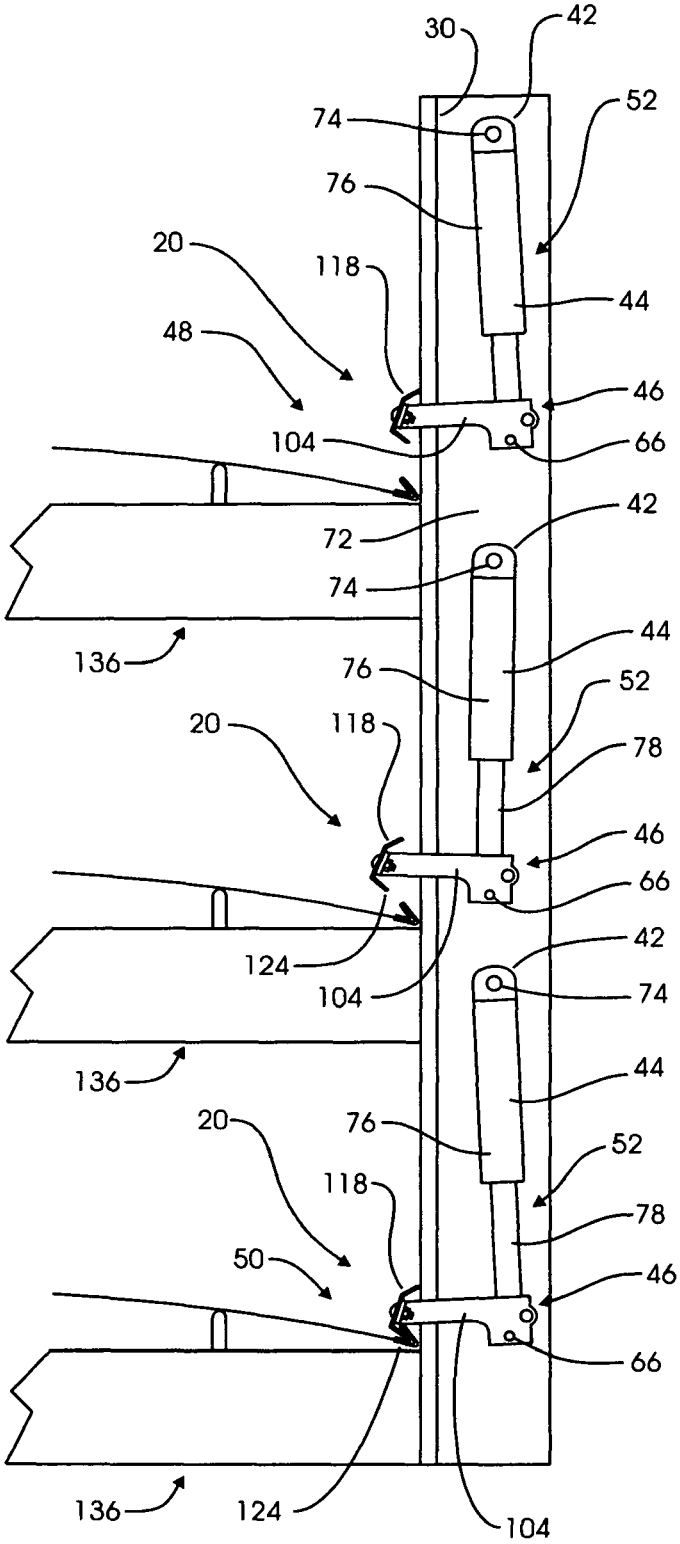
FIG. 2A is an enlarged cross section as illustrated in FIG. 2 (right side) to show with greater clarity and detail the clamp rail assembly securely maintaining a clamp rail in various stages of engagement, the top clamp rail assembly being disengaged from the screen, and the bottom clamp rail assembly being fully engaged with the screen to tension the same.

In another aspect of the invention, a portion of the track 62 is inclined toward the side wall 28 to vary the track 62 to decrease the distance between the track 62 and the side wall 28 as the movable end 46 of the actuator 44 moves from the first releasing position, illustrated in FIG. 2 top deck 48, toward the second engaging position 50. As a result, responsive to the track variations, the track follower 66 is urged in a transverse direction, toward the sidewall 28 causing the clamp rail assembly 52 to move in a transverse direction toward the screen 22 prior to engagement with the screen 22.

Considering now in more detail the structure of the components from which a tensioning apparatus 20 is constructed, one embodiment of the present invention includes an actuator support 36 defined by a pair of vertically oriented, spaced-apart support members constructed from flat metal plates 72 having opposing holes 73 disposed to receive a through bolt 74. The metal plates 72 are fixed to a sidewall 28 by welds or the like and are spaced so that a hydraulic ram 76 can be held in place, between the metal plates 72 by the through bolt 74. With this arrangement, the hydraulic ram 76 functions as an actuator 44 with the stationary end 42 thereof being held in place by a through bolt 74.

Likewise, the hydraulic ram 76 includes a movable cylinder 78 that defines the movable end 46. The movable end 46 is formed to define a radially disposed groove 80. As will be seen below, the groove 80 engages with the clamp rail assembly 52, and is removably fixed thereto by a track follower 66. In addition, a track follower 66 comprises a threaded shaft 84 threadedly coupled to a receiving shaft 86. The threaded shaft 84 defines a smooth track end 88 and a threaded end 90. Additionally, a nut 92 is fixed between the track end 88 and the threaded end 90. Similarly, the receiving shaft 86 comprises a threaded receiving nut 94 disposed on one end of shaft 95 defining a smooth track surface 98. In this way, the receiving shaft 86 can threadedly receive the threaded shaft 84 as illustrated in FIG. 3.

Linked to the track follower 66 is a clamp rail assembly 52 provided to apply the force of the hydraulic ram 76 to the screen 22. For that purpose, a clamp rail assembly 52 comprises a clamp rail base 102 having a cylinder attachment lug 104. The cylinder attachment lug 104 defines a bore 106 sized to receive the movable end 46 of the movable cylinder 78. Also, a compression gap 108 is provided so that the track follower 66 can be positioned through follower receiving bore 110 which extends through the cylinder attachment lug 104. In this way, the track follower 66 can be tightened to compress the cylinder attachment lug 104 around the movable end 46. Importantly the, the follower receiving bore 110 is disposed so that the track follower 66 engages with groove 80 of the movable cylinder 78. Accordingly, this construction fixes the movable cylinder 78 to the clamp rail assembly 52.

Importantly, the clamp rail base 102 is constructed to define opposing rail mounting arms 114 and 116 that provide a structure to which a clamp rail 118 is attached. For that purpose, fastener bores 120 are provided through each rail mounting arm 116, 114 so that fasteners 122 can be applied to hold the clamp rail 118 to the clamp rail base 102 through holes 121. Further, cylinder attachment lug 104 is elongated so that it can extend through a sidewall opening 54 so that the rail mounting arms 116 and 118 can be located adjacent the screen 22 and its screen hook 56.

Figure 3:
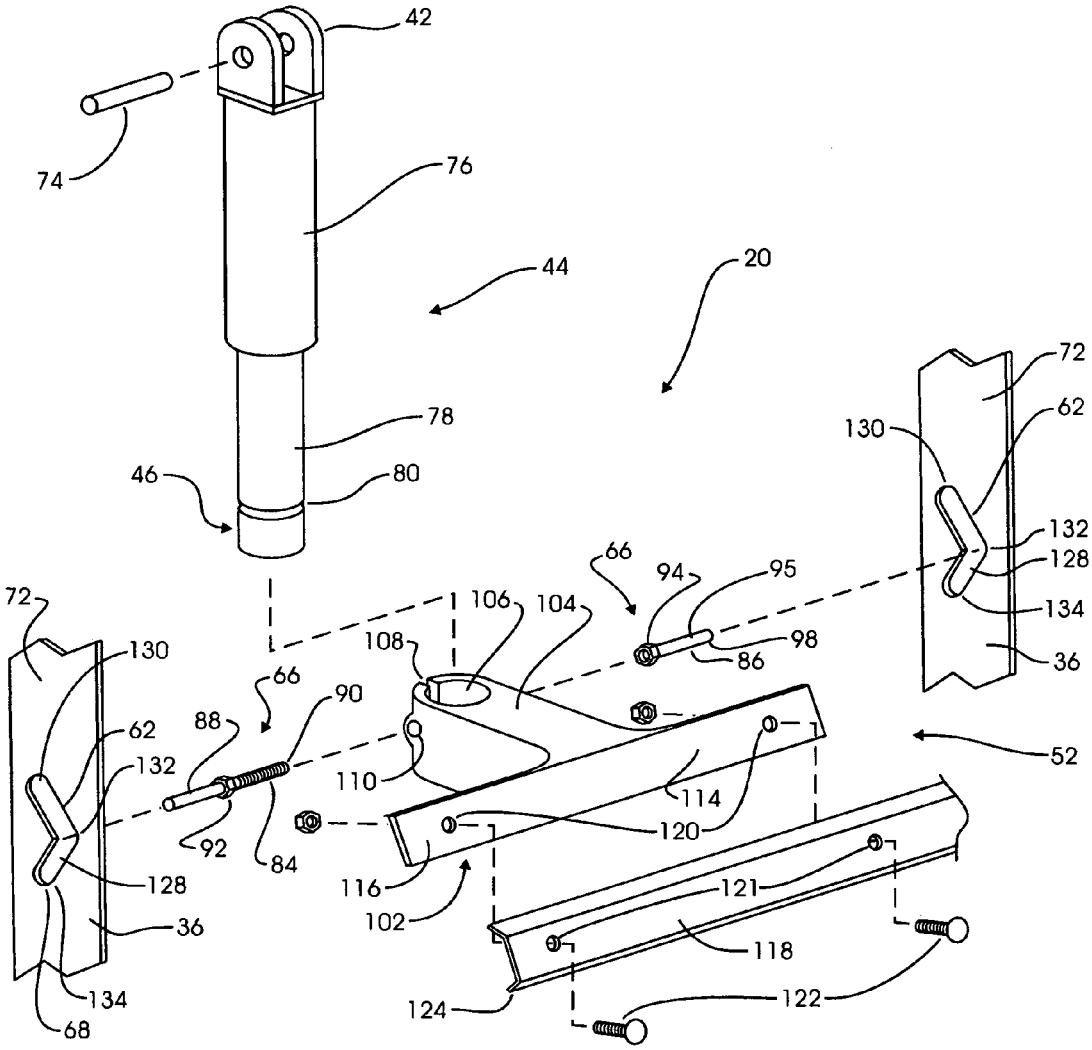
FIG. 3 is an exploded perspective view of a clamp rail assembly.
Figure 4:
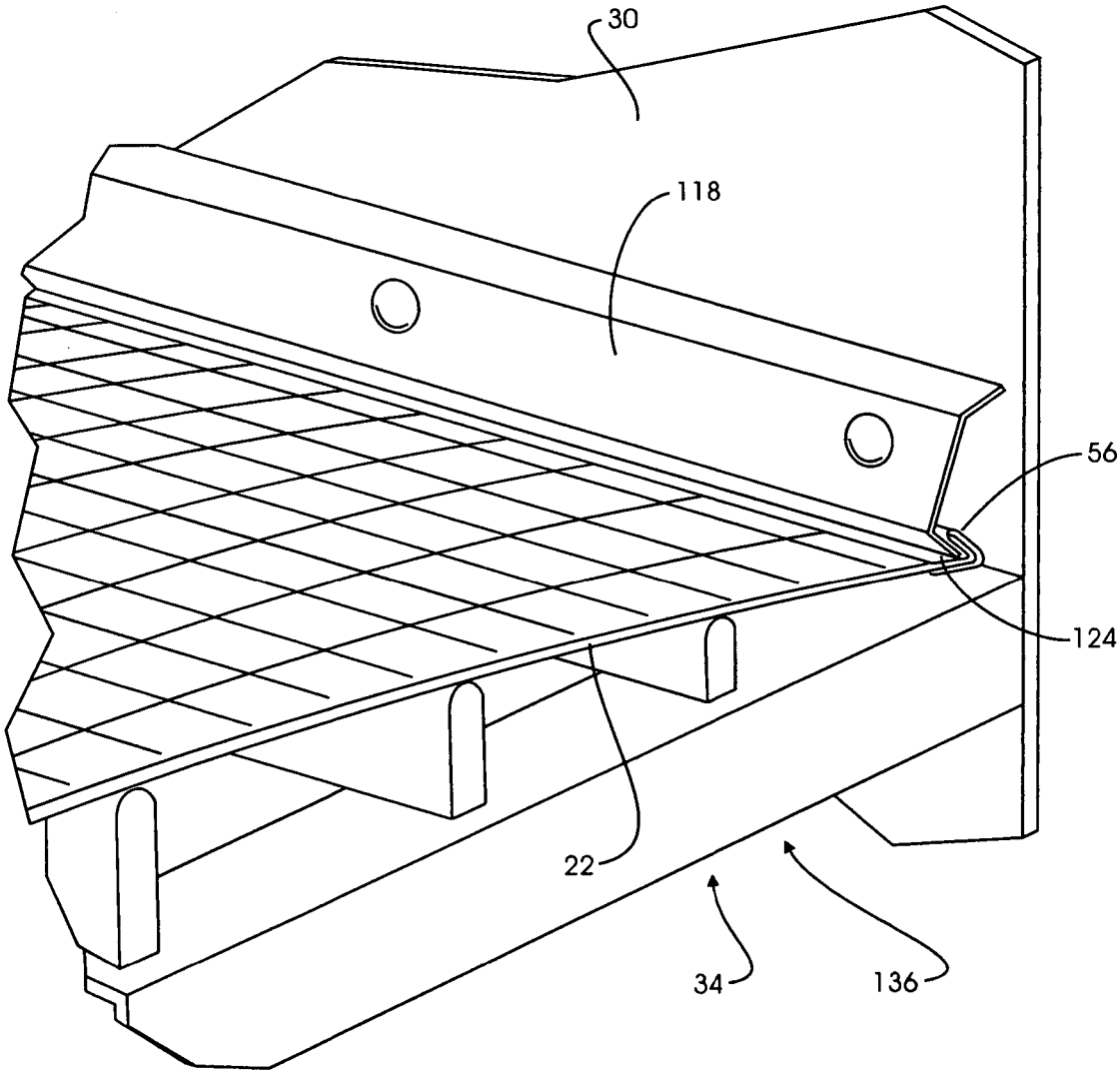
FIG. 4 is an exploded perspective view of a clamp rail fully engaged with a screen hook.

Directing attention to FIGS. 3 through 5, the clamp rail 118 is provided to engage the screen hook 56 as the actuator 44 moves to the second engaging position. Accordingly, the clamp rail 118 is shaped to define an elongate leading edge 124 which engages the screen hook 56.

Turning again to FIG. 3, track 62 is defined by opposing matching elongate slots 128 formed in spaced apart metal plates 72. The slots 128 are sized so the track follower 66 can extend horizontally to engage each slot 128. Each elongate slot 128 extends from an upper starting point 130, downward on an incline toward the sidewall 28 to a point 132 where the slot changes direction to extend further downward on an incline away from the sidewall to a ending point 134. In this way, as the hydraulic cylinder 78 moves from the first releasing position illustrated in FIG. 2 upper deck 48, where the track follower 66 is disposed at the upper starting point 130, to the second engaging position illustrated in FIG. 2 bottom deck 50, where the track follower 66 is disposed at the ending point 134, the clamp rail assembly 52 moves according to the movement of the track follower 66 along the length of the slot 128. As a result, the clamp rail assembly 52 is first urged inward so that the clamp rail 118 moves toward the screen 22 and screen hook 56 thereof, and then outward and downward to engage the screen hook 56 and tension the screen 22 as the clamp rail 118 is further urged outward, away from the screen, along with the track follower 66. It should be noted that the slots 128 could conform to other contours or profiles. For example, the slots could have a more curved profile where the change in direction would be more consistent along the entire movement from the first releasing position 48 to the second engaging position 50 (this example is not illustrated).

Directing attention to FIG. 2, a vibrating screen separator 24, having multiple alike, vertically stacked, deck structures 136 is illustrated. Specifically, a cross section of a box structure 26 is shown that incorporates an embodiment of the present invention showing the sequence of the screen tightening process. In FIG. 2, the top deck 48 illustrates the clamp rail 118 disengaged from the screen hook 56, with the track follower disposed at the upper starting point 130 of the slot 128. The middle deck illustrates the clamp rail 118 moving downward prior to engagement with the screen hook 56, where the track follower is disposed at the transition point 132 of the slot 128. Finally, the bottom deck 50 illustrates the clamp rail 118 fully engaged with the screen hook 56 to apply tension to the screen 22 across the bottom deck support structure 136 with the track follower disposed at the ending point 134 of the slot 128.

Importantly, a vibrating screen separator 24 of the type having multiple deck structures 136 would employ a plurality of tensioning apparatus 20, each being connected to a central hydraulic system, having hydraulic controls (not illustrated). Such tensioning apparatus could be disposed on the outside of each sidewall 28, 30 as illustrated in FIG. 2. Additionally, one arrangement would provide each tensioning apparatus 20 with its own hydraulic controls for operating the actuator 44 to cycle from the first releasing position to the second engaging position. Moreover, each hydraulic control could be constructed with pressure valves to control the force with which the hydraulic cylinders apply to the clamp rail assembly 52. In this way, consistent tension is applied to the screens 22 throughout the vibrating process. It should be understood that, hydraulic systems employed with the present invention are common, and typically are constructed of well known designs which are beyond the scope of this detailed description.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A screen tensioning apparatus for tensioning a screen in a vibrating screen separator of the type having a box structure defined by two opposing spaced-apart upright side walls separated by at least one screen bed support structure, the tensioning apparatus comprising:

an actuator support mounted to an exterior surface of a side wall of a box structure;

an actuator having a stationary end pivotally linked to the actuator support, and a movable end that is cyclically movable from a first releasing position, to a second engaging position;

a clamp rail assembly fixed to the movable end of the actuator, the clamp rail assembly adapted to extend from the movable end of the actuator, through an opening formed in the side wall, into the box structure adjacent a screen having a screen hook disposed on the edge thereof;

a track disposed adjacent the exterior surface of the sidewall;

a track follower extending from the clamp rail assembly for sliding engagement with the track responsive to movement of the movable end of the actuator; and wherein a portion of the track is inclined from the side wall to vary the distance of the track from the sidewall along the track so that as the movable end of the actuator is moved from the first releasing position to the second engaging position, the track follower is urged in a transverse direction, as it slides along the track, away from the side wall, to induce transverse movement of the clamp rail assembly for engagement with the screen to urge the same toward the side wall for tensioning the screen across the screen bed support structure.

2. A tensioning apparatus as recited in claim 1 wherein an upper portion of the track is inclined in relation to the side wall to vary the track to decrease the distance between the track and the side wall as the movable end of the actuator moves from the first releasing position toward the second engaging position, wherein responsive to movement along the track, the track follower is urged in a transverse direction, toward the sidewall causing the clamp rail assembly to move in a transverse direction, prior to engagement with the screen, toward a screen hook disposed to define the edge of the screen.

3. A tensioning apparatus as recited in claim 2 wherein a lower portion of the track is inclined in relation to the side wall to vary the track to increase the distance between the track and the side wall as the movable end of the actuator moves from the first releasing position toward the second engaging position, wherein responsive to movement along the track, the track follower is urged in a transverse direction, away from the sidewall.

4. A tensioning apparatus as recited in claim 1 wherein a lower portion of the track is inclined in relation to the side wall to vary the track to increase the distance between the track and the side wall as the movable end of the actuator moves from the first releasing position toward the second engaging position, wherein responsive to movement along the track, the track follower is urged in a transverse direction, away from the sidewall.

5. A tensioning apparatus as recited in claim 1 wherein the actuator support comprises two vertically oriented spaced apart support members disposed to receive the actuator between the same.

6. A tensioning apparatus as recited in claim 5 wherein the two vertically oriented spaced apart support members extend in length to receive the actuator between the same, and to define the track which receives the track follower.

7. A tensioning apparatus as recited in claim 6 wherein the track which receives the track follower is defined by two opposing slots formed in the two spaced apart support members.

8. A tensioning apparatus as recited in claim 7 wherein the clamp rail assembly comprises a track follower having opposing members, including a track end, and a receiving shaft that extend substantially horizontally in opposite directions to respectively engage the opposing slots formed in the two spaced apart support members.

9. A tensioning apparatus as recited in claim 8 wherein a plurality thereof are disposed on each side wall of a vibrating screen separator, to act in concert to tension at least one screen therein.

10. A method for making a screen tensioning apparatus for tensioning a screen in a vibrating screen separator of the type having a box structure defined by two opposing spaced-apart upright side walls separated by at least one screen bed support structure, the tensioning apparatus comprising:

mounting an actuator support to an exterior surface of a side wall of a box structure;

pivotally linking a stationary end of an actuator to the actuator support, wherein the actuator comprises a movable end that is cyclically movable from a first releasing position, to a second engaging position;

fixing a clamp rail assembly to the movable end of the actuator, the clamp rail assembly adapted to extend from the movable end of the actuator, through an opening formed in the side wall, into the box structure adjacent a screen having a screen hook disposed on the edge thereof;

defining a track disposed adjacent the exterior surface of the sidewall;

extending a track follower, from the clamp rail assembly, for sliding engagement with the track responsive to movement of the movable end of the actuator; and arranging a portion of the track so that a portion of the track is inclined from the side wall to vary the distance of a portion of the track from the sidewall along the track so that as the movable end of the actuator is moved from the first releasing position to the second engaging position, the track follower is urged in a transverse direction, as it slides along the track, away from the side wall, to induce transverse movement of the clamp rail assembly for engagement with the screen to urge the same toward the side wall for tensioning the screen across the screen bed support structure.

11. A method for making a screen tensioning apparatus as recited in claim 10 wherein an upper portion of the track is inclined in relation to the side wall to vary the track to decrease the distance between the track and the side wall as the movable end of the actuator moves from the first releasing position toward the second engaging position, wherein responsive to movement along the track, the track follower is urged in a transverse direction, toward the sidewall causing the clamp rail assembly to move in a transverse direction, prior to engagement with the screen, toward a screen hook disposed to define the edge of the screen.

12. A method for making a screen tensioning apparatus as recited in claim 11 wherein a lower portion of the track is inclined in relation to the side wall to vary the track to increase the distance between the track and the side wall as the movable end of the actuator moves from the first releasing position toward the second engaging position, wherein responsive to movement along the track, the track follower is urged in a transverse direction, away from the sidewall.

13. A method for making a screen tensioning apparatus as recited in claim 10 wherein the actuator support comprises two vertically oriented spaced apart support members disposed to receive the actuator between the same, and wherein the track which receives the track follower is defined by two opposing slots formed in the two spaced apart support members.

14. A method for making a screen tensioning apparatus as recited in claim 13 wherein the clamp rail assembly comprises a track follower having opposing members, including a track end, and a receiving shaft that extend substantially horizontally in opposite directions to respectively engage the opposing slots formed in the two spaced apart support members.

15. A screen tensioning apparatus for tensioning a screen in a vibrating screen separator of the type having a box structure defined by two opposing spaced-apart upright side walls separated by at least one screen bed support structure, the tensioning apparatus comprising:

an actuator support mounted to surface of a side wall of a box structure;

an actuator having a stationary end pivotally linked to the actuator support, and a movable end that is cyclically movable from a first releasing position, to a second engaging position;

a clamp rail assembly fixed to the movable end of the actuator, adjacent a screen having a screen hook disposed on the edge thereof;

a track disposed adjacent a surface of the sidewall;

a track follower extending from the clamp rail assembly for sliding engagement with the track responsive to movement of the movable end of the actuator; and wherein a portion of the track is inclined from the side wall to vary the distance of the track from the sidewall along the track so that as the movable end of the actuator is moved from the first releasing position to the second engaging position, the track follower is urged in a transverse direction, as it slides along the track, away from the side wall, to induce transverse movement of the clamp rail assembly for engagement with the screen to urge the same toward the side wall for tensioning the screen across the screen bed support structure.

16. A screen tensioning apparatus as recited in claim 15 wherein the actuator support is mounted to an exterior surface of a side wall of a box structure, with the clamp rail assembly adapted to extend from the movable end of the actuator, through an opening formed in the side wall, into the box structure, and the track is disposed adjacent the exterior surface of the of the sidewall.

17. A screen tensioning apparatus as recited in claim 15 wherein an upper portion of the track is inclined in relation to the side wall to vary the track to decrease the distance between the track and the side wall as the movable end of the actuator moves from the first releasing position toward the second engaging position, wherein responsive to movement along the track, the track follower is urged in a transverse direction, toward the sidewall causing the clamp rail assembly to move in a transverse direction, prior to engagement with the screen, toward a screen hook disposed to define the edge of the screen.

18. A tensioning apparatus as recited in claim 17 wherein a lower portion of the track is inclined in relation to the side wall to vary the track to increase the distance between the track and the side wall as the movable end of the actuator moves from the first releasing position toward the second engaging position, wherein responsive to movement along the track, the track follower is urged in a transverse direction, away from the sidewall.

19. A tensioning apparatus as recited in claim 16 wherein a lower portion of the track is inclined in relation to the side wall to vary the track to increase the distance between the track and the side wall as the movable end of the actuator moves from the first releasing position toward the second engaging position, wherein responsive to movement along the track, the track follower is urged in a transverse direction, away from the sidewall.

20. A tensioning apparatus as recited in claim 16 wherein the actuator support comprises two vertically oriented spaced apart support members disposed to receive the actuator between the same, the two vertically oriented spaced apart support members extending in length to define the track which receives the track follower, wherein the track which receives the track follower is defined by two opposing slots formed in the two spaced apart support members.

* * * * *